United States Patent [19]

Sanvido

[11] 4,382,372

[45] May 10, 1983

[54] SECURITY DEVICE FOR REMOVABLY LOCKING TWO MOBILE ELEMENTS TOGETHER

[75] Inventor: Sergio Sanvido, Lugano, Switzerland

[73] Assignee: Bristol S.A., Luxembourg, Luxembourg

[21] Appl. No.: 187,592

[22] Filed: Sep. 15, 1980

[30] Foreign Application Priority Data

Apr. 8, 1980 [EP] European Pat. Off. ..... 80101867.2

[51] Int. Cl.[3] ..... E05B 25/08

[52] U.S. Cl. ..... 70/355; 70/384

[58] Field of Search ..... 70/134, 353, 354, 355, 70/352, 350, 382, 383, 337, 339, 384

[56] References Cited

U.S. PATENT DOCUMENTS

| | | | |
|---|---|---|---|
| 2,221,664 | 11/1940 | Susser | 70/384 |
| 3,060,716 | 10/1962 | Butter | 70/134 |
| 3,371,512 | 3/1968 | Hutton | 70/353 |
| 3,514,982 | 6/1970 | Bergendahl | 70/355 |
| 3,762,192 | 10/1973 | Errani | 70/352 |
| 3,772,904 | 11/1973 | Parrock | 70/383 |
| 3,879,968 | 4/1975 | Schweizer | 70/81 |
| 3,884,058 | 5/1975 | Terry | 70/355 |
| 3,983,728 | 10/1976 | Phillips | 70/383 |

*Primary Examiner*—Cornelius J. Husar

*Attorney, Agent, or Firm*—Fitch, Even, Tabin & Flannery

[57] ABSTRACT

This invention relates to a security device for removably locking two mobile elements together, for example a door and the frame on which it is mounted. In particular, the device is in the form of a lock, and is intended for fixing to one of the elements, for example a door, and includes an engagement member such as a bolt, able to move from an engagement position to a disengagement position and vice versa, control means, for example a key for the engagement member, and one or more elements for transmitting the operation of the control means to the engagement member. Each transmission element comprises two or more sectors able to move towards and away from the respective transmission element. Each sector cooperates with a sliding rocker element able to interact with the engagement member and be controlled sequentially by the control means by way of one or more transmission elements, to allow movement of the engagement member.

14 Claims, 13 Drawing Figures

SECURITY DEVICE FOR REMOVABLY LOCKING TWO MOBILE ELEMENTS TOGETHER

BACKGROUND OF THE INVENTION

This invention relates generally to a security device for removably locking two mobile elements together. The security device is intended for fixing to one of the two elements, and includes an engagement member arranged to move from a position of engagement to a position of disengagement and vice versa, control means for the engagement member, and one or more elements for transmitting the operation of the control means to the engagement member.

More particularly, the present invention relates to a lock for closing and locking doors and the like, the lock being of the type which can be adapted to different keys. More specifically, the lock can be arranged to operate either with one or more keys, it being possible to replace each key independently of the others.

Certain existing locks comprise an arrangement of two opposing components, each of which is compelled by the action of a key to assume a variable position relative to the other. There is also a known lock comprising a group of transmission elements intended for operation by a key. Each transmission element of the group is pivoted, and operates a single abutment element to allow the movement of a bolt. However, this lock has the disadvantage of being able to be adapted to only one key at a time. This means that it is impossible for the lock to be able to be operated by two different keys, for example a change key and a master key.

There are also known locks which although not adaptable to different keys, comprise two groups of transmission elements which also perform the function of control elements. However, the control elements are intended to simultaneously allow the movement of the bolt.

Locks known as one or more level master key locks are also available commercially, these being operable by one or more master keys according to the number of levels, and by one change key. In these locks, the keys preset one or all the consent arrangements or combinations which govern the locking and release of the bolt.

Known multiple-level locks generally have the disadvantages that it is not possible to replace any one of the master keys of the change key without replacing at least a large part of the control mechanisms. This can give rise to serious drawbacks if it becomes necessary to make a master or change key inoperable, for example, in the case of loss, withdrawal or copying of a key.

SUMMARY OF THE INVENTION

The object of the present invention is to provide a security device for removably locking two mobile elements together, in particular a security lock which can be adapted to different keys and can be arranged to operate with one or more keys, with the possibility of replacing any key independently of the others. In other words, the security device must be able to be operated not only by keys, for example master keys and a change key, which are different from each other and without the key changes being interdependent, but also with absolute independence in replacing any one key relative to the others without it being necessary either to modify the other keys or to have them available or otherwise know them, and without having to replace or alter the components of the device or security lock.

A further object of the present invention is to make said security device unable to be operated by so-called hybrid keys, i.e. keys in the form of a mixed combination of different operable keys, for example master keys and the change key, i.e. keys which comprise active elements (teeth) both of the master keys and of the change key.

A further object of the present invention is to make the positions of the locking and unlocking transmission elements illegible in said security device, so that it is not possible to make impressions from the lock which would allow control keys to be illegally reproduced.

A further object of the present invention is to enable a key to be replaced in said security lock only by using the key to be replaced.

These and further objects which will be more apparent hereinafter are attained by a security device for removably locking two mobile elements together, the device being designed to be fixed to one of the two mobile elements and having a bolt member arranged to be displaced from a locked to an unlocked position and vice versa, at least two actuation keys which differ from one another, control means for allowing the bolt member to be displaced by the actuation key, and at least one transmission element arranged to operate the control means and to be actuated by either actuation key. For each transmission element the control means of the security device comprises a pair of first and second engagement members movably mounted on respective supports provided on a common adjustable carrier, and a respective matching element for the first and the second engagement member. With this structure each one of the actuation keys can cause either of the first or the second engagement members to match with its respective matching element, thereby allowing the bolt member to be displaced.

BRIEF DESCRIPTION OF THE DRAWINGS

Further features and advantages of the invention will be more apparent from the detailed description given hereinafter of preferred but not exclusive embodiments, illustrated by way of non-limiting example in the accompanying drawings, in which.

DESCRIPTION OF THE PREFERRED EMBODIMENTS

Figure 2:
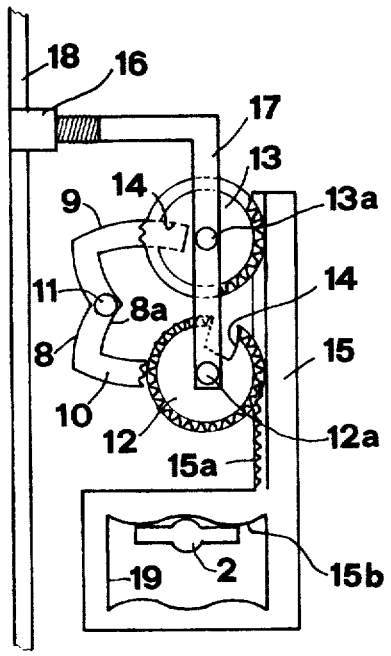
FIG. 2 is a diagrammatic elevation of further components which are superposed on the components of FIG. 1 in order to complete the security device.
Figure 1:
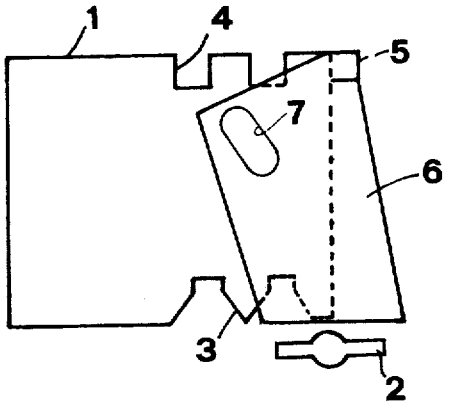
FIG. 1 is a diagrammatic front elevation of certain components of a first embodiment of the device in accordance with the invention.

FIGS. 1 and 2 show a bolt 1 operable by a key 2 by virtue of its toothing 3. The bolt 1 also comprises notches or cavities 4 disposed on that side thereof opposite the side comprising the toothing 3. The cavities 4 are intended to receive and removably engage a locking pawl 5 which is rigid with a slide 6, in which there is provided a slot 7 defining a plane inclined to the longitudinal axis of the bolt 1.

As it rotates, the key 2 raises the slide 6 and consequently also its pawl 5 in order to disengage the bolt 1, so that it can make its traversing movement either in the forward or return direction.

FIG. 2 shows a sliding rocker element 8 in the form of a transverse portion 8*a* terminating in two arms 9 and 10 which extend at an angle to the portion 8*a* and are disposed on the same side of it. The transverse portion 8*a* is rigid with a pin 11 for insertion into the slot 7 in the slide 6 (FIG. 1). In order for the key 2 to be able to raise the slide 6, the pin 11 must be able to move from left to right (when viewing FIG. 1) by the effect of the lifting of the slide 6. This lateral movement of the pin 11 can take place if one of the two groups or packs of control elements, in this case constituted by gears 12, 13, is correctly aligned so as to be able to present a respective notch 14 (which is a control element governing the locking and release of the bolt) in front of one of the arms 9 or 10, to enable one of the arms of the rocker element 8 to penetrate into the gear. The other arm of the element 8 then rests against the other pack of gears, and acts as a point of rotation or fulcrum for the rocker element 8, the pin 11 of which is thus free to make a movement which enable the slide 6 to be raised. The correct alignment of one of the packs of gears 12 or 13 is effected by the key 2, which acts against key abutment portions 15*b* to operate racks 15*a* provided on transmission elements, for example of the lever tumbler type 15, each of which is common to two respective gears 12 and 13. The gears 12 and 13 are rotatably mounted in two spaced-apart positions about pins 12*a* and 13*a* supported by a common support member 17 in the shape of an elbow or right-angled lever. One end of the support 17 is threaded, and is screwed into a nut screw 16 rigid with a fixed part 18 of the security device.

When it is required to change the key, the authorized key 2 is firstly inserted and is rotated into the position in which an arm of the sliding element 8 is able to enter a notch 14. The nut screw 16 is then turned so that, according to the direction in which it is turned, it moves one of the packs of gears 12, 13, while the other remains resting against the rack unit 15. The pack of gears which becomes withdrawn thus disengages from the racks 15*a*, and becomes mounted on the respective arm of the rocker element 8, which then remains locked in this position without being able to rotate. The authorized key 2 is then removed, and a new key inserted. The nut screw 16 is then rotated in order to bring the gear pack again in engagement with the rack 15*a*, and the device or lock is thus changed to the new key. The same operations are carried out on the other pack of gears 12 or 13 using a different key, in this case only the direction of rotation of the nut screw 16 and thus the direction of movement of the lever 17 being different.

It is therefore apparent that the security device or lock illustrated in FIGS. 1 and 2 offers absolute guarantee with regard to illegibility or decoding. In this respect, the lever tumblers 15 comprise at one of their ends (lower part of FIG. 2) shaped apertures 19 which are accessible to the key 2, but which give no indication regarding their combination in order to allow decoding. For this purpose, the lever tumblers 15 are spring-loaded, so that when the key is removed, they all return into their initial position. From the foregoing description, it is apparent that a lock according to the present invention is a device operable by two keys, one of which acts on one of the two packs of gears and the other acts on the other pack of gears. If one key is made common to a group of locks such as that heretofore described, it becomes a so-called master key, and if the other key is different for each lock of the group, these other keys will form so-called change or specific keys. In this manner, a series of locks with a grandmaster key system is formed.

With both types of key, security devices or locks can be constructed of one or more throws.

In order to be able to operate the security device or lock from two sides, for example from the inside and outside of a door, in addition to using keys with a tooth profile symmetrical about an axis normal to the key shank and passing through the centre line of the key bits, keys can be used having any tooth profile, i.e. without any symmetry constraint. This is possible by arranging the lock such that when the key enters from one side it engages with one pack of gears, whereas when it enters from the other side it engages with the other pack.

In this manner, all the control elements of the security lock or device contribute to forming the consent combinations (i.e. combinations allowing the locking or release of the bolt), whereas in the case of keys having a symmetrical tooth profile, only half the teeth are usable. Consequently, the number of combinations obtainable is much greater than the number obtainable with keys with symmetrical teeth.

It should be noted that the said facility for changing combination or key is provided without having to alter the lock components, but simply by arranging them according to the key which is to be used. Moreover, the new key to be used can be any key already obtainable commercially. This is also possible for two keys (for example a master key and the change key) which are completely independent of each other both with regard to the combination of their teeth and with regard to the possibility of replacing either both of them, or only one of them independently of the other.

The aforesaid is also valid for the embodiment illustrated in FIGS. 3 to 7, which show a security lock according to the invention provided with a spring bolt. Equal parts or those which have the same function as those illustrated in FIGS. 1 and 2 are indicated by the same reference numerals.

Figure 7:
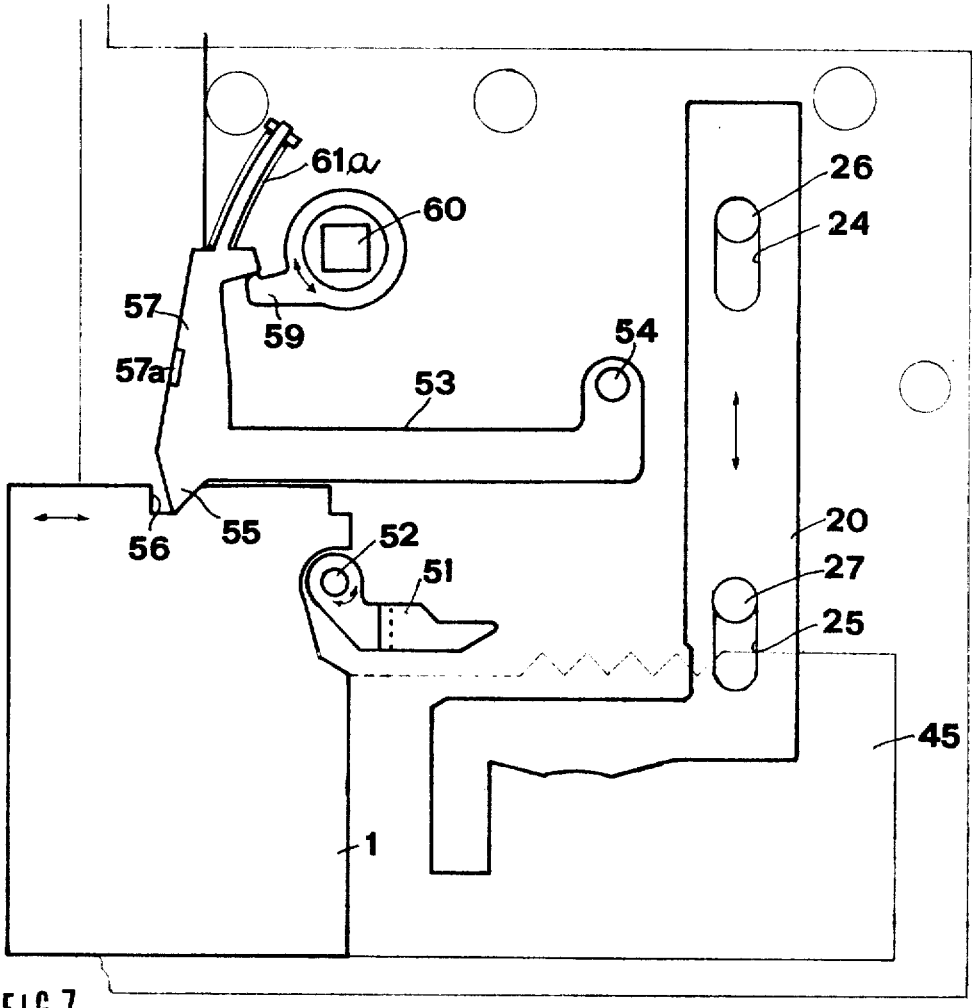
FIG. 3 to 7 illustrate components which form a further embodiment of a security device in accordance with the invention, FIGS. 3 and 4 showing components which in FIGS. 5 to 7 are rotated through 90°.
Figure 3:
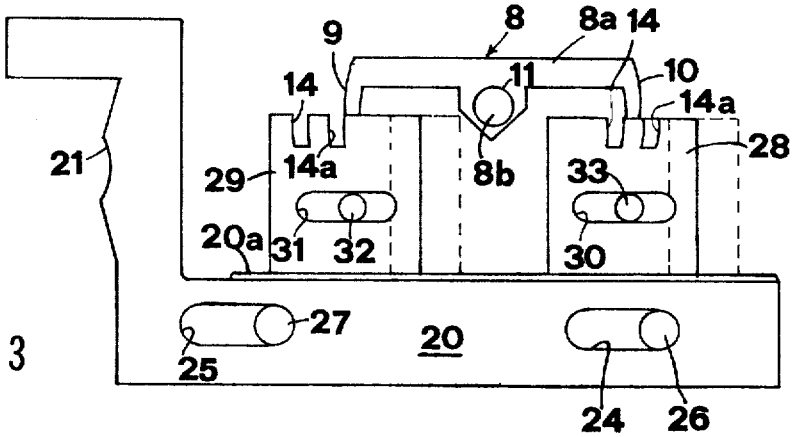
Figure 6:
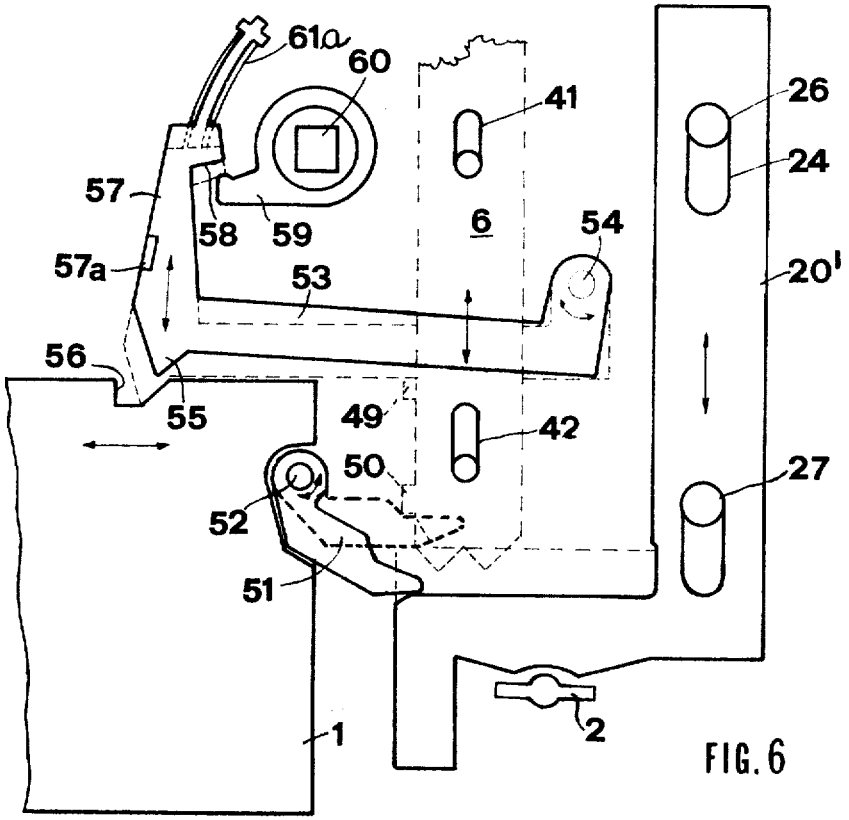
Figure 4:
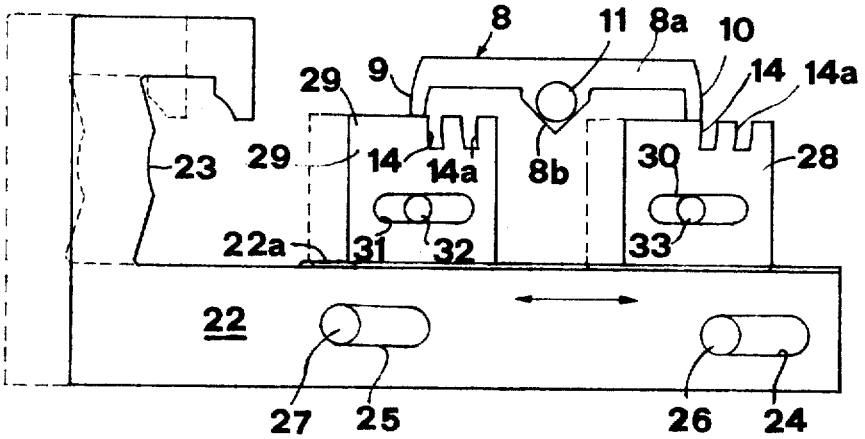
Figure 5:
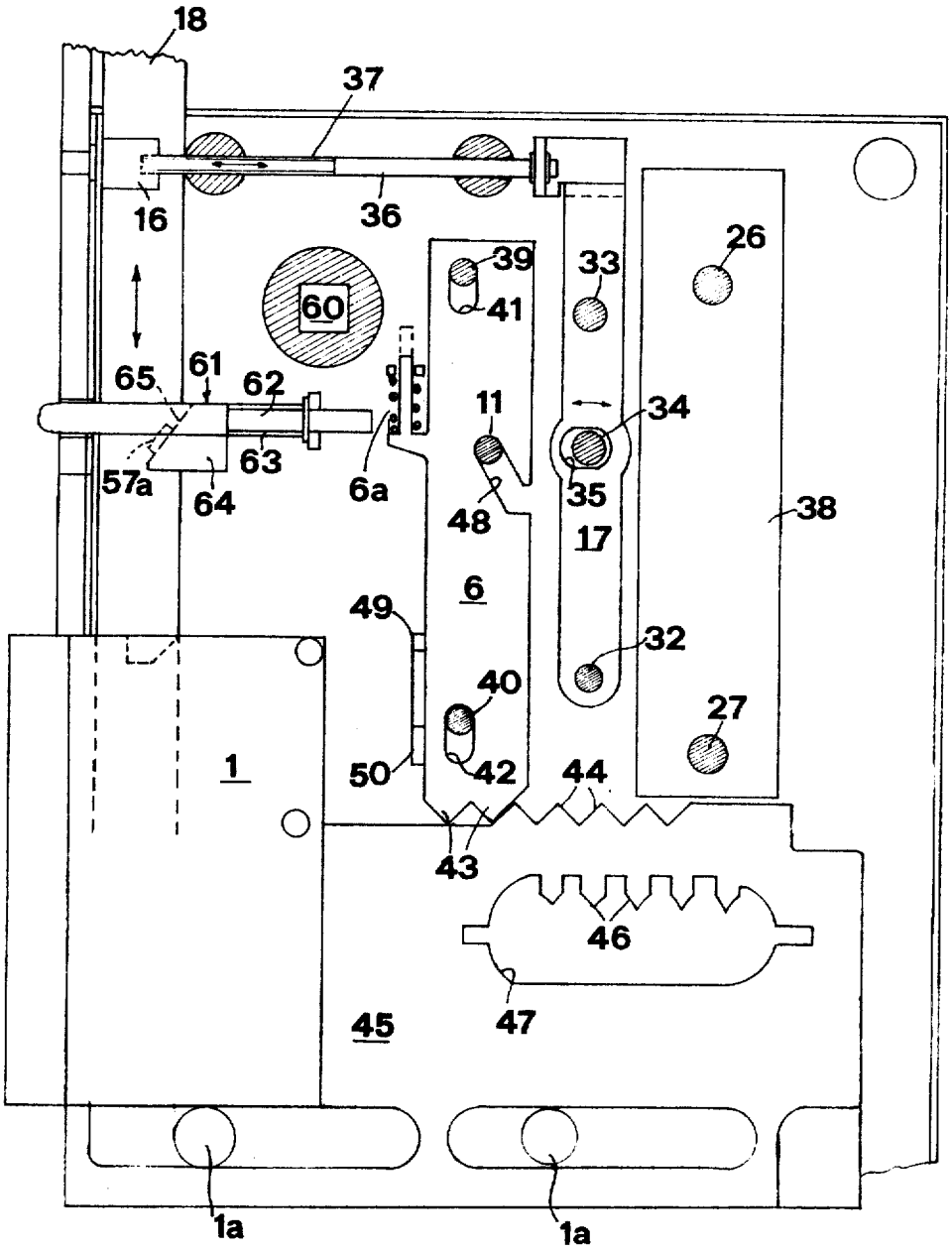

In particular, FIGS. 3 and 4 show two different types of lever tumbler used in the security device, FIG. 3 showing a rising lever tumbler, while FIG. 4 shows a falling lever tumbler, FIG. 5 is an elevation showing some supports and components of the security lock. FIGS. 6 and 7 show other components which form part of the safety device, and are superposed on the components shown in FIG. 5.

As can be seen in FIGS. 3 and 4, instead of all comprising an aperture 19 as in FIG. 2, the lever tumblers 15 are divided into two types, i.e. rising lever tumblers 20 (FIG. 3) which are raised by the key at their lower profile 21, against which the key makes contact, and falling lever tumblers 22 (FIG. 4) which are lowered by the action of the key 2 acting against their lower profile 23. Each tumbler 20 or 22 comprises two slots, namely an upper slot 24 and a lower slot 25, for slidably receiving respective guide pins 26 and 27. Each lever tumbler also comprises respective toothing 20*a* or 22*a*, with which pairs of plate-like toothed abutment elements 28 and 29 engage to perform the function of the gears 12 and 13 of the embodiment described heretofore. The abutment elements 28 and 29 comprise a respective slot 30, 31 for slidably receiving a respective guide pin 32 and 33. The guide pins 32 and 33 are rigid (FIG. 5) with a common support 17 constituted in this case by a lever arm slackly pivoted about a pin 34 passing through a slot 35. The support 17 comprises an arm 36 disposed at a right angle to it, and terminating in a thread 37 engaged in a nut screw 16 connected to a fixed part 18 of the lock.

Each toothed abutment element or pack of abutment elements 28 and 29 cooperates with a respective arm 9, 10 of a sliding element or floating stump 8 comprising, in its intermediate portion 8*a* which connects together the arms 8 and 10, an appendix 8*b* on which a pin 11 is rigidly provided. The floating stump 8 is common to the toothed abutment elements of all the lever tumblers 20 and 22, and constitutes a sliding element which allows the forward and return movements of the bolt 1, in the manner explained below.

The lever tumblers 20 and 22 are divided into two packs or groups, i.e. one half are disposed below and one half above a spacer block 38 (FIG. 5), and are mounted on its pins 26 and 27, whereas the control elements 28 and 29 are mounted on the pins 32 and 33, one half being above and one half below the element 17 disposed adjacent to the block 38. In proximity to the element 17, there is disposed the slide 6 which is slidable on guides consisting of an upper pin 39 and a lower pin 40 seated slidably in respective slots 41 and 42 in the slide 6. The slide 6 lowerly comprises two teeth 43, which normally engage with corresponding teeth 44 provided on the end 45 of the bolt 1. This end also comprises a second set of teeth 46 provided within an aperture 47 for the insertion of the key 2 with which the toothing 46 is designed to engage during successive throws. The bolt 1 and its end 45 are also slidably supported by supports indicated overall by 1*a*.

As stated heretofore, the slide 6 normally engages with the bolt, being thrust thereagainst by its spring 6*a*, which acts against a fixed part of the lock. The slide 6 also defines an inclined plane 48, along which the pin 11 of the floating stump or sliding element 8 slides. As can be seen from FIGS. 5 and 6, the slide 6 also comprises two projections, namely an upper projection 49 and a lower projection 50. The projection 50 is intended for engagement by a lever 51 having one end pivoted on a pin 52 rigid with the bolt, and its other and disposed in the path of movement of a lever tumbler 20' (FIG. 6) intended for engagement by a particular tooth of the key. When the key 2 acts in the sense of raising the tumbler 20' opposite the lever 51, this latter acts against the projection 50, to raise the slide 6. Simultaneously, the projection 49 is made to act against the lower edge of a lever 53 pivoted at 54 to a fixed part of the lock. At its free end, the lever 53 comprises a tooth 55 arranged to engage in a notch or cavity 56 in the bolt. The lever 53 also comprises an extension 57 with an undercut 58 arranged to act against a tooth 59 of a handle indicated overall by 60. The appendix 57 is loaded by a spring 61*a* which acts against a fixed part of the lock. When the projection 49 raises the lever 53 in the sense of rotating it about its pin 54, the tooth 55 is released from the cavity 56, so that the bolt 1 can be moved.

As can be seen, the lever tumbler 20' for operating the lever 51 acts only at the end of the opening throws of the bolt 1, when it has engaged with the tooth 55 so as to act as a spring bolt. It is therefore a security spring bolt, in that the key must be used to pull it back. In this respect, when the bolt 1 is withdrawn, i.e. in its spring bolt position, in order for it to be able to further move backwards and thus release for example a door, the tooth 55 of the lever 53 must be released from the cavity 56 as stated. This can be done either by operating the handle 60 from the inside, this raising the lever 53 by means of the tooth 59 and then withdrawing the bolt 1 (by means of a ratchet gear, not shown), or by operating the key from the outside. The key raises the tumbler 20' of FIGS. 6 and 7, which is not a tooth tumbler as are the other lever tumblers 20 which act against the control elements 28 and 29. By means of the lever 51 and projection 50, the tumbler 20' raises the slide 6, which causes the lever 53 to rotate on its pin. However, the slide 6 can be raised only if the floating stump or sliding element 8 meets either the notch 14 or 14*a* of the control elements 28 or 29, i.e. only if an authorised key is used.

Consequently, when the lock is open the bolt 1 acts as a spring bolt, whereas with the lock closed it acts as a proper bolt. The spring bolt can therefore be released from the outside only with a key, whereas from the inside it can be release either with a key or with the handle.

As can be seen from FIG. 5, the safety lock also comprises a follower indicated overall by 61, comprising a rod 62 loaded by a spring 63 and with a projection 64 defining an inclined plane 65. The inclined plane 65 is designed to act against an appendix 57*a* of the lever 53 (FIG. 6). By this means, when the door on which the lock is mounted is opened, the rod 62 emerges to the outside of the lock and by means of the block 64 keeps the lever 53 raised. When the door is closed, the rod 62 is compelled to withdraw into the lock, to allow the lever 53 to fall so that its tooth 55 engages in the cavity 56 of the bolt 1, to keep it locked in position.

The operation of the lock heretofore described is similar to that of the embodiment shown in FIGS. 1 and 2.

However, as can be seen from FIGS. 3 and 4, the control elements 28 and 29 each have a double notch 14 and 14*a* disposed at a constant distance apart so as to be able to increase the combination possibility between the control element and respective lever tumbler. In particular, the double notch serves to enable the use of a combination of teeth, or a key for example with two bits, one bit comprising a first set of teeth and the other a second set of teeth. Each tooth of the first set has a corresponding tooth in the second set which occupies the same position, and has a height which can be equal, or reduced or increased (with respect to the tooth of the first set) by a constant distance, equal to the distance between the notches 14, 14*a*. In this manner, keys can be used having different bit profiles on the two bits. These keys make it possible to give several throws to the bolt, using the two bits alternately and engaging a single group of control elements 28, 29.

Moreover, by simply varying the distance between the notches 14, 14*a*, locks are obtained for each variation which can be operated by sets of keys having tooth combinations correlated with the distance variation made. This means that it is possible to produce and use sets of keys which are different but not interchangeable, to the advantage of security. In a like manner, two notches 14, 14*a* can also be provided on each of the gears 12, 13 in the embodiment of FIGS. 1 and 2, to give the same advantages and same facility for varying and increasing the combinations.

In addition, in FIGS. 3 to 7, lever tumblers 20, 22 are used which are rising and falling, so that teeth of both the key bits (instead of only one bit) are used for each throw (180° rotation of the key) of the bolt, to the advantage of security.

Obviously, two keys could be used for controlling a lock such as that shown in FIGS. 3 to 7, one key acting on the pack of control elements 28, and the other on the pack of control elements 29.

If one example double-bitted keys are used with teeth of heights which are symmetrical about an axis transverse to the key shank and passing through the centre line of the bits (i.e. symmetrical semi-profile keys), it is possible to operate with the same key from both sides of the lock by always acting on a single pack of control elements 28,29. With a lock such as that described with reference to FIGS. 3 to 7, it is possible with a single key to carry out more than one throw and to operate the lock either from the inside or from the outside, by engaging a single pack of control elements, for example the pack 29. A second pack of control elements, for example the pack 28, is therefore available for operation with a second key. In this manner, a multiple-level key system can be used, this being a two-level key system in the example illustrated.

This can obviously be done while retaining the possibility of being able to change the authorised keys totally independently of each other for each key level.

Figure 8:
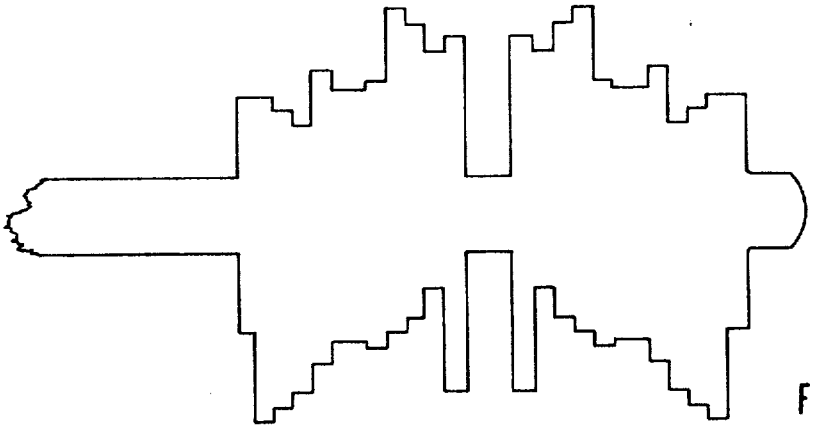
FIG. 8 shows a preferred key embodiment for operating the device illustrated in FIGS. 3 to 7.

According to an advantageously aspect of the present invention, it is also possible to use a four bit key for opening from both sides of the lock. This key can for example have the shape shown in FIG. 8, which shows a four bit key comprising symmetrical paired profiles. The key of FIG. 8 therefore allows the lock shown in FIGS. 3 to 7 to be controlled from both sides using a single pack of control elements. However, this key makes all the control elements of a group 28 or 29 usable for the combination, instead of only part as with the symmetrical semi-profile double-bitted keys, thus allowing a much larger number of combinations, to the advantage of security.

The lock heretofore described can also be arranged for control by different keys for each throw, and thus in order to be able to effect more than one throw it is necessary for example to use at least two different keys. This is done obviously by engaging a single pack of control elements 28, 29. This multiple-level operation is valid also for the second pack of control elements, and thus for example the following situations can be attained:

multiple-level lock opening (for example with two keys each for one throw), using a first pack of control elements, with the simultaneous possibility of opening the lock with a third key which is a combination of the first two and which acts on the same pack, or a third completely different key which acts on the second pack and effects two throws;

double-level opening, attained by two different keys (each for carrying out one throw), acting on a first pack of control elements, and two different keys (one throw each) which each act on the second pack of control elements;

a total three-level master key system (the keys all to be used, and in sequence), two of which operate on one pack and one operating on the other, the first two keys being arranged to carry out a single throw, and the third to carry out two throws; and a four-level master key system, all keys operating in sequence, i.e. two keys acting on one pack and two keys on the other.

Obviously by increasing the number of packs of control elements and the relative lever tumblers together with the sliding elements (floating stumps), it is possible to correspondingly increase the number of keys operating independently and/or in sequence on the lock, so as to attain more than one level of key operation according to the various requirements, always with the facility for replacing the keys, for operating from the two sides of the lock and for constructing multiple-throw locks.

FIGS. 9 to 13 show other embodiments of the security device, in particular a lock, according to the invention. The drawings use the same reference numerals to indicate parts equal or equivalent to those already described with reference to FIGS. 1 and 2.

Figure 9:
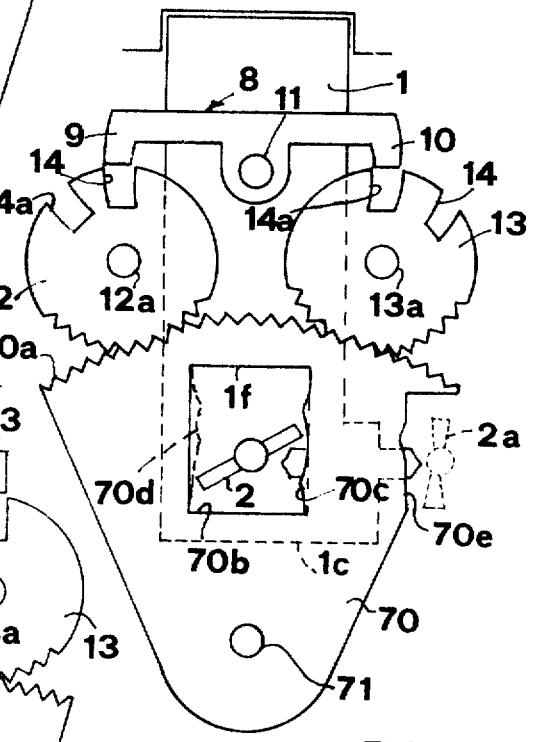
FIG. 9 is a diagrammatic elevation of a further embodiment of the security device in accordance with the present invention.

FIG. 9 illustrates a diagrammatic embodiment similar to that illustrated in FIG. 2, with the exception that the transmission elements in this case are constituted by one or more toothed sectors 70 pivoted on a pin 71 and intended to engage with respective gears 12, 13 by way of toothing 70*a*. The gears 12, 13 are mounted rotatably on pins 12*a* and 13*a*, and can be moved away from and towards the respective toothed sector 70, for example in the manner illustrated in FIG. 2. The end 1*c* of the bolt 1 comprises an aperture 1*f* for the passage of a key 2. In a position corresponding with the aperture 1*f*, each sectors 70 comprises an aperture 70*b* profiled on one side 70*c* only. If use is made of a pack of sectors 70, each of these can comprise the profiled side 70*c*, and others can have the side 70*d* opposite the side 70*c* profiled, so that as the key 2 rotates, it can cause some sectors to rotate about the pin 71 in one direction and other sectors in the opposite direction.

The sectors 70 are spring-loaded in order to return them into their initial or zero position after the operation of the key.

Advantageously, the sectors 70 can also be all equal, and comprise a single profiled side, for example the side 70*c*, and also comprise a profiled notch 70*e* external to the aperture 70*b* in order to define a second key point, for example for inserting a master key 2*a*. Finally, the gears 12, 13 comprise notches 14, 14*a* to engage with the arms 9, 10 of a floating stump 8 pivoted at 11 on the bolt 1. Consequently, a lock such as that illustrated in FIG. 9 can perform all the functions performed by the locks of FIGS. 1 and 2 and FIGS. 3 to 7, attaining the same advantages, plus the facility for providing two key points.

Figure 10:
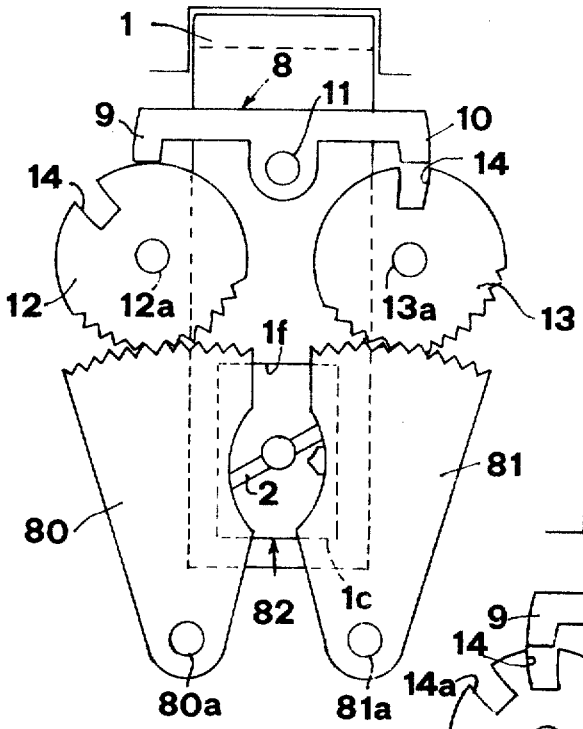
FIG. 10 is a view similar to FIG. 9, but showing a further embodiment of the present invention.

FIG. 10 shows an embodiment in which the gears or packs of gears 12, 13 are operated by respective toothed sectors 80 and 81, between which there is a key point indicated overall by 82. In a like manner to the security device shown in FIG. 9, the bolt 1 comprises an aperture 1*f* for the passage of a key 2, and the edges of the sectors 80 and 81 adjacent to the aperture 1*f* are profiled to engage with the teeth of the key 2. The sectors 80 and 81 are pivoted on respective pins 80*a* and 81*a*, and are spring-loaded.

It is thus possible to form a lock comprising two or more groups of transmission elements constituted by packs of toothed sectors 80, 81, each of which is arranged to engage with key changes which are totally independent of each other but are provided on the same key. It is therefore possible to make the opposing teeth on the key or the keys operate simultaneously, without the heights of the opposing teeth having to be related or otherwise dependent on each other. This is because the number of key teeth corresponds to the number of transmission elements. In addition, the number of key changes obtainable is thus the square of the number of changes obtainable when the heights of the opposing teeth are related to each other by any relationship.

Figure 11:
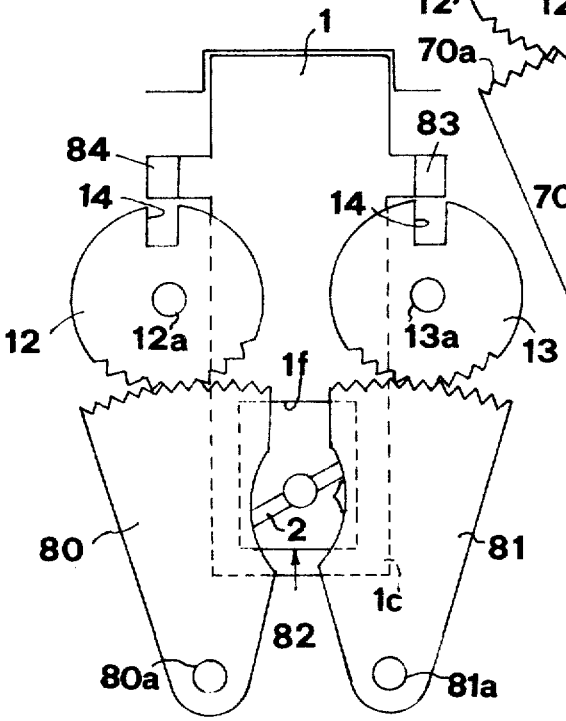
FIG. 11 is a diagrammatic elevation of a further embodiment of the security device in accordance with the present invention.

FIG. 11 shows a lock embodiment similar to that of FIG. 10, but in which the control elements 12, 13 have to interact simultaneously with respective projections 83, 84 on the bolt 1 to allow the bolt to move. In contrast to known locks of the simultaneous interaction type, the lock of FIG. 11 is adaptable to different keys.

Figure 12:
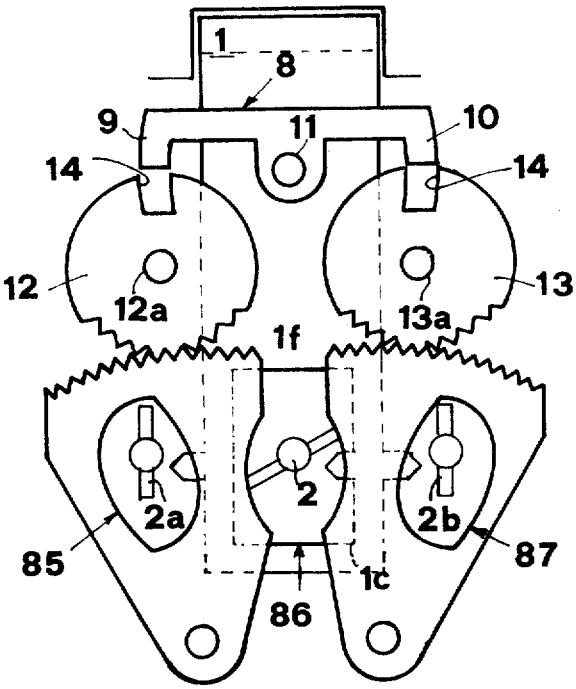
FIG. 12 is a view similar to FIG. 10, but showing a modification.

FIG. 12 shows a lock similar to that of FIG. 10, but with three key points 85, 86, 87. With this lock it is thus possible to use three different keys 2, 2*a*, 2*b*, and to obtain for example three-level master key operation.

Figure 13:
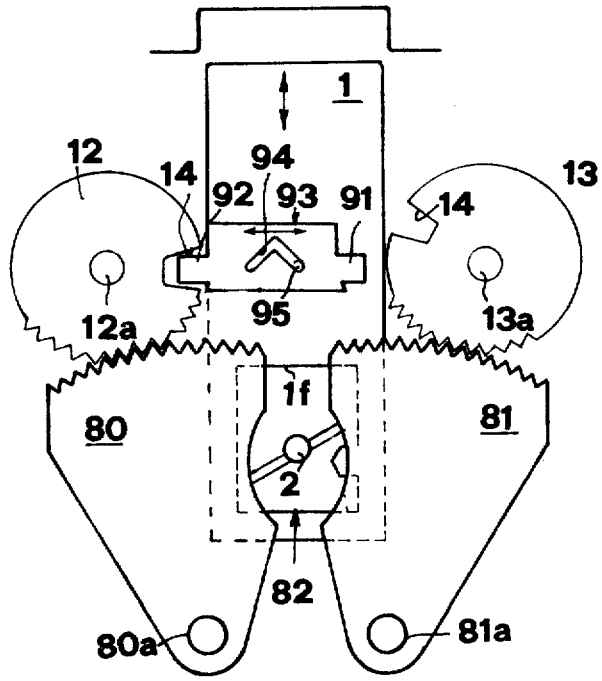
FIG. 13 is a view similar to FIG. 12, but showing a further embodiment of the present invention.

FIG. 13 shows a lock comprising two toothed sectors or sector groups 80, 81 engaged with respective gears 12, 13 designed to engage with a respective tooth 91, 92 of a slide 93. The slide 93 comprises a slot 94 defining two inclined planes which diverge away from each other. A pin 95 rigid with the bolt 1 is slidably inserted into the slot 94. As is apparent, the key 2 is able to move the bolt 1 only if one of the teeth 91 or 92 penetrates into the notches 14 of one of the groups of gears 12, 13. This penetration is possible if the toothed sectors 80, 81 have duly positioned the gears 12, 13, and if the slide 93 has been able to slide on the pin 95.

It is apparent that with a lock according to the invention, there is the important advantage of being able to produce locks which are all equal to each other, and each of which can be adapted to any key change.

The security device heretofore described and illustrated in the accompanying drawings is susceptible to numerous modifications, all of which fall within the scope of the inventive idea.

I claim:

1. In a security device for removably locking two mobile elements together, the device being designed to be fixed to one of the two mobile elements and having a bolt member arranged to be displaced from a locked to an unlocked position and vice versa, at least two actuation keys which differ from one another, control means for allowing the bolt member to be displaced by the actuation keys, and at least one transmission element arranged to operate the control means and to be actuated by either actuation key, the improvement wherein for each transmission element the control means comprises a pair of first and second engagement members movably mounted on respective supports provided on a common adjustable carrier, and a respective matching element for the first and the second engagement member, whereby each one of the actuation keys can cause either the first or the second engagement member or members to match with its respective matching element, thereby allowing the bolt member to be displaced.

2. A device as claimed in claim 1, wherein the transmission elements and their respective engagement members are arranged in two separate groups, the components of one group being designed to move in the opposite direction to those of the other group.

3. A device as claimed in claim 1, wherein each engagement member is arranged to engage with a transmission element by friction contact.

4. A device as claimed in claim 1, wherein each engagement member is arranged to engage with a transmission element by means of toothing.

5. A device as claimed in claim 4, wherein each engagement member comprises a toothed wheel mounted for rotation on the carrier and having at least one peripheral engagement notch.

6. A device as claimed in claim 4, wherein each engagement member comprises a plate-like member having one side engaged with a respective transmission element and another side formed with one or more engagement notches, the plate-like members being slidably mounted on the carrier.

7. A device as claimed in claim 1, further comprising a traversing member arranged to selectively engage with the engagement members to allow the bolt member to be displaced.

8. A device as claimed in claim 7, wherein the traversing member has at least one surface delimiting an inclined plane against which the bolt member is designed to abut.

9. A device as claimed in claim 1, wherein the said matching element comprises a floating pump having two end arms.

10. A device as claimed in claim 9, wherein the floating stump is designed to straddle the first and the second engagement members and its arms are arranged selectively to penetrate into notches in either the first or the second engagement members after the same have been suitably operated by their respective transmission elements.

11. A device as claimed in claim 1, wherein the keys have symmetrical toothed profile.

12. A device as claimed in claim 11, wherein a key comprises four bits.

13. A device as claimed in claim 1, wherein the bolt member is arranged to operate as a spring bolt.

14. A device as claimed in claim 13, further comprising a locking lever arranged to keep the bolt member in its locked position.

* * * * *